US007318396B1

(12) United States Patent
Belter et al.

(10) Patent No.: US 7,318,396 B1
(45) Date of Patent: Jan. 15, 2008

(54) COOLING SYSTEM FOR A MARINE PROPULSION ENGINE

(75) Inventors: David J. Belter, Oshkosh, WI (US); William D. Lanyi, Malone, WI (US); Richard A. Davis, Mequon, WI (US); Steve Wynveen, Germantown, WI (US); Christopher J. Taylor, Kiel, WI (US)

(73) Assignee: Brunswick Corporation, Lake Forest, IL (US)

( * ) Notice: Subject to any disclaimer, the term of this patent is extended or adjusted under 35 U.S.C. 154(b) by 289 days.

(21) Appl. No.: 11/156,869

(22) Filed: Jun. 20, 2005

(51) Int. Cl.
*F02F 1/14* (2006.01)

(52) U.S. Cl. ..... 123/41.8; 123/41.29; 440/88 C

(58) Field of Classification Search ..... 123/41.8, 123/41.08, 41.09, 41.29; 440/88 C
See application file for complete search history.

(56) References Cited

U.S. PATENT DOCUMENTS 3,358,654 A * 12/1967 Shanahan et al. ..... 123/41.08
5,769,038 A 6/1998 Takahashi et al. .... 123/41.82 R
5,904,605 A 5/1999 Kawasaki et al. ..... 440/88
5,937,801 A 8/1999 Davis ..... 123/41.33
5,937,802 A 8/1999 Bethel et al. ..... 123/41.74
5,970,926 A 10/1999 Tsunoda et al. ..... 123/41.29
6,135,833 A 10/2000 Tsunoda ..... 440/88
6,331,127 B1 12/2001 Suzuki ..... 440/88
6,394,057 B1 5/2002 Fukuoka et al. ..... 123/195 P
6,561,140 B2 5/2003 Nagashima ..... 123/41.08
6,682,380 B1 1/2004 Irwin et al. ..... 440/88 C
6,821,171 B1 11/2004 Wynveen et al. ..... 440/88 C
6,976,892 B2 12/2005 Tawa et al. ..... 440/88 G
6,976,893 B2 12/2005 Tawa et al. ..... 440/88 C
2004/0127116 A1 7/2004 Tawa et al. ..... 440/88 C
2004/0192126 A1 9/2004 Tawa et al. ..... 440/88 C

* cited by examiner

*Primary Examiner*—Stephen K. Cronin
*Assistant Examiner*—Katrina Harris
(74) *Attorney, Agent, or Firm*—William D. Lanyi

(57) ABSTRACT

A cooling system for a marine engine incorporates first and second thermally responsive valves which are responsive to increases in temperature above first and second temperature thresholds, respectively. The two thermally responsive valves are configured in serial fluid communication with each other in a cooling system, with one thermally responsive valve being located upstream from the other.

25 Claims, 8 Drawing Sheets

COOLING SYSTEM FOR A MARINE PROPULSION ENGINE

BACKGROUND OF THE INVENTION

1. Field of the Invention

The present invention is generally related to a marine propulsion engine and, more specifically, to a cooling system which provides two controlled water diversions (e.g. thermostats) at different locations within a series connected plurality of cooling paths in order to more precisely control the temperature of cooling water within those respective cooling paths.

2. Description of the Related Art

Many different types of engine cooling systems are known to those skilled in the art. More specifically, many different types of cooling systems for marine engines are known.

U.S. Pat. No. 5,769,038, which issued to Takahashi et al. on Jun. 23, 1998, describes a liquid cooling system for an engine. The liquid cooling arrangement for an internal combustion engine has a cylinder block with a cylinder head connected thereto and defines at least one combustion chamber, a common exhaust passage extending through the cylinder block, and an exhaust passage leading from each combustion chamber to the common exhaust passage. The liquid cooling arrangement includes a pump for pumping cooling liquid from a cooling liquid source first through at least one passage extending through the cylinder head generally adjacent the exhaust passages leading from the combustion chambers, and through at least one passage extending through the cylinder block generally adjacent the common exhaust passage. Once the cooling liquid has passed through these passages, the cooling liquid is delivered to one or more passages extending through the cylinder head or block generally adjacent to combustion chambers. The cooling liquid then selectively passes a thermostat into a cooling liquid return line through which the cooling liquid is drained from the engine.

U.S. Pat. No. 5,904,605, which issued to Kawasaki et al. on May 18, 1999, describes a cooling apparatus for an outboard motor. The outboard motor is provided with a water cooling engine in a vertical alignment. A crankshaft is vertically disposed. The engine comprises a cylinder block, a cylinder head and an exhaust manifold into which water jackets are formed respectively and the water jackets are supplied with cooling water from a water pump disposed below the engine in a state mounted to a hull. The cooling apparatus comprises a cylinder cooling water passage for supplying cooling water from the water pump to the water jackets of the cylinder block and the cylinder head, an exhaust cooling water passage for supplying cooling water from the water pump to the water jacket of the exhaust manifold, the cylinder cooling water passage and the exhaust cooling water passage being independently disposed from each other and being joined together at downstream portions thereof. A thermostat is provided for the water jacket of the cylinder block and a sensor for detecting the temperature of a cylinder surface is provided for the water jacket of the cylinder block at a portion between the water jacket thereof and the thermostat.

U.S. Pat. No. 5,937,802, which issued to Bethel et al. on Aug. 17, 1999, discloses an engine cooling system for an internal combustion engine. It is provided with coolant paths through the cylinder block and cylinder head which are connected in serial fluid communication with each other. In parallel with the cooling path through the cylinder head, a first drain is connected in serial fluid communication with a pressure responsive valve and the path through the cylinder block. A temperature responsive valve is connected in serial fluid communication with the cylinder head path and in parallel fluid communication with the first drain. A pump is provided to induce fluid flow through the first and second coolant conduits and the first and second drains, depending on the status of the pressure responsive valve and the temperature responsive valve.

U.S. Pat. No. 5,937,801, which issued to Davis on Aug. 17, 1999, discloses an oil temperature moderator for an internal combustion engine. A cooling system is provided for an outboard motor or other marine propulsion system which causes cooling water to flow in intimate thermal communication with the oil pan of the engine by providing a controlled volume of cooling water at the downstream portion of the water path. As cooling water flows from the outlet of the internal combustion engine, it is caused to pass in thermal communication with the oil pan. Certain embodiments also provide a pressure activated valve which restricts the flow from the outlet of the internal combustion engine to the space near the oil pan. One embodiment of the cooling system also provides a dam within the space adjacent to the outer surface of the oil pan to divide that space into first and second portions. The dam further slows the flow of water as it passes in thermal communication with the oil pan.

U.S. Pat. No. 5,970,926, which issued to Tsunoda et al. on Oct. 26, 1999, describes an engine cooling system for an outboard motor. An engine includes first exhaust passages formed in a cylinder head, a second exhaust passage formed in a cylinder block and communicating with the first exhaust passages, and a cooling water passage having water jacket portions formed around the combustion chambers. The cooling water passage includes a first water jacket and a second water jacket. The cylinder head and the cylinder block are fixedly connected together by bolts. The second exhaust passage opens at a joining surface of the cylinder block along cylinders, which opening is surrounded by the bolts.

U.S. Pat. No. 6,135,833, which issued to Tsunoda on Oct. 24, 2000, describes an engine cooling system for an outboard engine. The system includes a thermostat mounted on an upper surface of a cylinder block to open and close a cooling water passage depending on the temperature of cooling water inside the cooling water passage and a relief valve mounted on the upper portion of the side wall of the cylinder block and located adjacent to the thermostat to open and close the cooling water passage depending on the pressure of cooling water inside the cooling water passage.

U.S. Pat. No. 6,331,127, which issued to Suzuki on Dec. 18, 2001, describes a marine engine for a watercraft. It includes a cooling system having a coolant supply. The coolant supply supplies an engine coolant jacket with a flow of coolant that is controlled by a temperature dependent flow control valve. The coolant supply also supplies an exhaust conduit coolant jacket independently of the engine coolant jacket.

U.S. Pat. No. 6,394,057, which issued to Fukuoka et al. on May 28, 2002, describes an arrangement of components for an engine. An exhaust system of the engine has an exhaust manifold extending along a cylinder body. At least a part of the air induction system of the engine exists to overlap with the exhaust manifold in a view along an extending axis of the exhaust manifold. A cooling system having at least two coolant passages is further provided. A coolant flow control mechanism is arranged to prevent only the coolant within one of the passages from flowing therethrough when temperature of the coolant is lower than a predetermined temperature.

U.S. Pat. No. 6,682,380, which issued to Irwin et al. on Jan. 27, 2004, describes a marine engine cooling system. The cooling system includes cylinder cooling jackets, cylinder head cooling jackets and thermostatic and pressure controls which facilitate safely operating the engine with low water flow rates.

U.S. Pat. No. 6,821,171, which issued to Wynveen et al. on Nov. 23, 2004, discloses a cooling system for a four cycle outboard engine. The system conducts water from a coolant pump through a cylinder head and exhaust conduit prior to conducting the cooling water through the cylinder block. This raises the temperature of the water prior to its entering the cooling passages of the cylinder block.

U.S. Pat. No. 6,561,140, which issued to Nagashima on May 13, 2003, describes a water cooling system for an engine. A housing unit defines a water delivery passage and a water discharge passage. Both the passages communicate with each other through a lower opening. The water delivery passage is arranged to deliver cooling water to the engine. The water discharge passage is arranged to discharge the cooling water from the engine. The discharge passage communicates with a location out of the housing unit through an upper opening. A pressure relief valve unit extends through the lower and upper openings. The pressure relief valve unit allows the cooling water in the delivery passage to move to the discharge passage when a pressure of the delivery passage becomes greater than a preset pressure.

U.S. patent application Ser. No. 10/674,815, which was filed by Tawa et al. on Oct. 1, 2003, describes a water cooled vertical engine and an outboard motor equipped therewith. Provided in a chain cover are thermostats for controlling the flow of cooling water in a cylinder block cooling water jacket and cylinder head cooling water jacket. Therefore, the thermostats can be accessed from the top of the engine for maintenance without being obstructed by the timing chain, and moreover it is easy to manipulate a drain pipe for discharging cooling water from the thermostats.

U.S. patent application Ser. No. 10/674,813, which was filed by Tawa et al. on Oct. 1, 2003, describes a water cooled vertical engine and an outboard motor equipped therewith. The engine includes an exhaust guide cooling water jacket and an exhaust manifold cooling water jacket which are formed in an engine compartment. A cylinder block cooling water jacket is formed in a cylinder block. A cylinder head cooling water jacket is formed in a cylinder head. Cooling water from a cooling water pump is supplied in parallel to an upper part and lower part of the cylinder block cooling water jacket through the exhaust guide cooling water jacket and the exhaust manifold cooling water jacket.

The patents described above are hereby expressly incorporated by reference in the description of the present invention.

It would be beneficial if a cooling system for a marine engine could be provided in which different cooling paths of the cooling system could be temperature controlled so that they are not all dependent on a common thermostat. This would allow certain heat emitting portions of the engine to be more rapidly cooled under certain dynamic conditions even though other portions of the engine, and their respective cooling paths, experience more slowly rising coolant temperatures.

SUMMARY OF THE INVENTION

A cooling system for a marine propulsion engine, made in accordance with a preferred embodiment of the present invention, comprises first and second cooling paths which are connected in series fluid communication with each other. It also comprises a water pumping device connected in series fluid communication with the first and second cooling paths and configured to pump water from a body of water and cause the water to flow serially through the first and second cooling paths. The second cooling path is disposed downstream from the first cooling path. It should be understood that the water pumping device can be a water pump which is driven either by the crankshaft of the engine or by an electric motor. In addition, the water pumping device can be one or more openings that are in fluid communication with the body of water and allow water to flow into the cooling system as a result of movement of the outboard motor through the water. In other words, the water pumping device can be an electromechanical apparatus or an arrangement of conduits that pump water as a function of the movement of an outboard motor or other marine propulsion device through the water. The cooling system, in a preferred embodiment of the present invention, further comprises a first thermally responsive valve connected in fluid communication with a first point of the cooling system which is downstream from the second cooling path. The first thermally responsive valve is configured to allow water to flow out of the second cooling path in response to a temperature of the water at the first point exceeding a first temperature threshold. A water conduit is connected in fluid communication with a second point of the cooling system which is downstream of the first cooling path and upstream of the second cooling path. The water conduit is configured to direct water to flow out of the first cooling path.

A preferred embodiment of the present invention can further comprise a second thermally responsive valve connected in thermal communication with the second point of the cooling system. The water conduit can be a bypass conduit connected in fluid communication with the second thermally responsive valve. In a preferred embodiment of the present invention, the first cooling path is an exhaust passage cooling path which is disposed in thermal communication with an exhaust passage which is formed as an integral part of the engine. The second cooling path can be a combustion chamber cooling path which is disposed in thermal communication with at least one combustion chamber formed in a head portion of the engine. Alternatively, the second cooling path can be a cylinder cooling path which is disposed in thermal communication with at least one cylinder formed in a block portion of the engine.

In a preferred embodiment of the present invention, it further comprises a water outlet connected in fluid communication with the first and second cooling paths and configured to return water to the body of water after the water has passed through the first and second cooling paths. In certain embodiments of the present invention, it further comprises a third cooling path connected in series fluid communication with the first and second cooling paths.

In a particularly preferred embodiment of the present invention, the cooling system comprises an exhaust passage cooling path which is disposed in thermal communication with a common exhaust passage of the engine and a combustion chamber cooling path which is disposed in thermal communication with combustion chambers of the engine and connected in series fluid communication with the exhaust passage cooling path. It also comprises a cylinder cooling path disposed in thermal communication with cylinders of the engine and connected in series fluid communication with the combustion chamber cooling path. The exhaust passage cooling path is connected in series fluid communication with the cylinder cooling path. This particular embodiment of the present invention further comprises a water pump connected in series fluid communication with the exhaust passage cooling path, the combustion chamber cooling path, and the cylinder cooling path and is connected upstream of the exhaust passage cooling path. A first thermally responsive valve is connected in fluid communication with a first point which is downstream from and in series fluid communication with the cylinder cooling path. The first thermally responsive valve, such as a thermostat, is configured to permit water within the cylinder cooling path to flow through the cylinder cooling path in response to a temperature of water within the cylinder cooling path exceeding a first temperature threshold. A water conduit is connected in fluid communication between a second point, which is downstream and in series fluid communication with the exhaust passage cooling path, and a third point which is downstream from the cylinder cooling path.

A particularly preferred embodiment of the present invention can further comprise a second thermally responsive valve connected in fluid communication with a second point which is downstream from and in series fluid communication with the exhaust passage cooling path. The second thermally responsive valve, such as a thermostat, is configured to permit water within the exhaust passage cooling path to flow through the exhaust passage cooling path in response to a temperature of water within the exhaust passage cooling path exceeding a second temperature threshold. The water conduit can be a bypass conduit connected in fluid communication with a second thermally responsive valve in order to permit a continuous flow of water past the second thermally responsive valve from the exhaust passage cooling path to the third point regardless of the open or closed status of the second thermally responsive valve.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
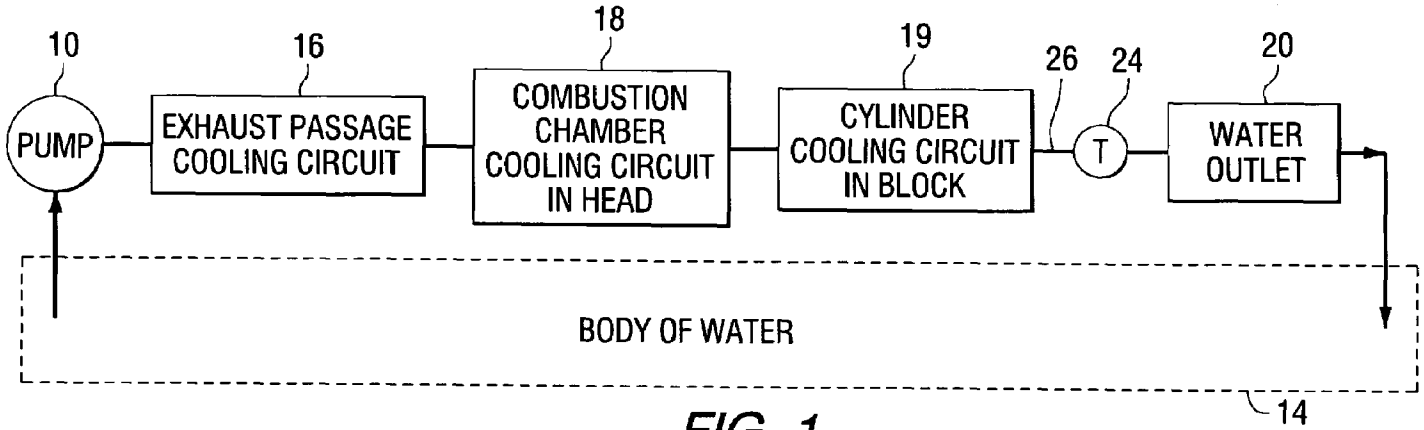
FIG. 1 PRIOR ART
FIG. 1 is a simplified representation of a known type of cooling path for a marine engine.

Throughout the description of the preferred embodiment of the present invention, like components will be identified by like reference numerals.

FIG. 1 is a highly simplified schematic representation of a known cooling system for a marine engine. A water pump 10 draws water from a body of water 14 and causes the water to flow through a series of cooling paths. As an example, water flowing from the water pump 10 first flows through an exhaust passage cooling path 16. The exhaust passage cooling path 16 is disposed in thermal communication with an exhaust passage of the marine engine. The exhaust passage can be a common exhaust passage through which all exhaust gases from the engine are emitted. In addition, the common exhaust passage can be formed as an integral part of the engine body. It can be cast as an integral part of the head portion of the engine. Water then continues to flow into a combustion chamber cooling path in the head of the engine. This combustion chamber cooling path is identified by reference numeral 18 in FIG. 1. Sequentially, the water flows from the combustion chamber cooling path 18 to the cylinder cooling path 19 which is contained in the block of the engine. From the cylinder cooling path 19, the water flows through a water outlet 20 which conducts the water back to the body of water 14 from which it was originally drawn by the water pump 10. The water outlet 20 can be a common conduit through which exhaust gases also flow from the engine. A thermally responsive valve 24 is illustrated in FIG. 1 at a first point 26 which is downstream from the cooling paths, 16, 18, and 19. The function of the thermally responsive valve 24, or thermostat, is to prevent water from flowing through the cooling paths until the water measured at the first point 26 exceeds a threshold temperature. This assures that the water in the cooling paths of the engine maintains the heat emitting portions of the engine at a preselected temperature. When the temperature of the cooling water at the first point 26 exceeds this preselected temperature, water is allowed to flow through the water outlet 20 to be returned to the body of water 14.

With continued reference to FIG. 1, it can be seen that the cooling system connects several cooling paths in series fluid communication with each other, draws water from a body of water 14 by a pump 10, and returns the water through water outlet 20 to the body of water.

Figure 2:
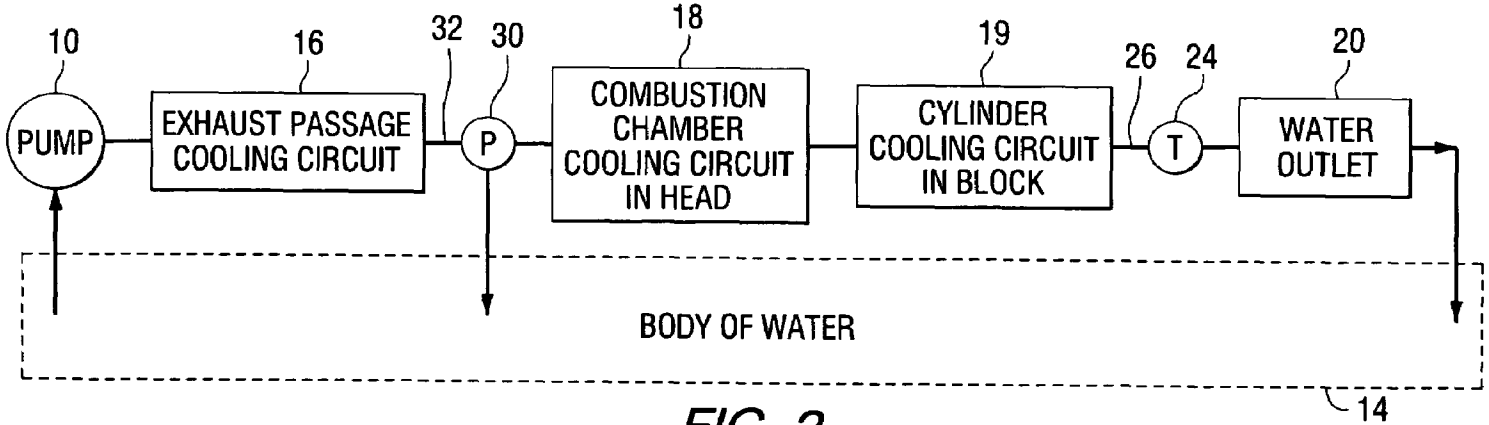
FIG. 2 PRIOR ART
FIG. 2 is a simplified representation of a known cooling path which incorporates a pressure sensitive valve.

FIG. 2 shows a known modification to the cooling system illustrated in FIG. 1. The modification includes the provision of a pressure sensitive valve 30 at a second point 32 which is downstream from the exhaust passage cooling path 16 and upstream from both the combustion chamber cooling path 18 and the cylinder cooling path 19 which are contained in the head and block, respectively, of the engine. The pressure responsive valve 30 is located downstream from the exhaust passage cooling path 16 which, in certain applications within the prior art, includes exhaust passages located in either the head or block, or both, of the marine engine. As will be described in greater detail below, the simplified representation shown in FIG. 2 is described in greater detail in U.S. Pat. No. 5,769,038. The inclusion of the pressure responsive valve 30 allows water to be induced to flow through the exhaust passage cooling path 16 in the event of a sudden rise in pressure within the cooling system. When this occurs, a pressure relief valve 30 opens to divert water back to the body of water 14 as represented by the arrow associated with the pressure responsive valve 30 in FIG. 2. This release of water, as a function of the increased pressure within the cooling system, allows cooler water to be directed into the exhaust passage cooling path 16 by the pump 10. The inclusion of the pressure response valve 30, as compared to the system shown in FIG. 1, avoids the situation where the temperature at the first point 26 rises more slowly than the temperature within the exhaust passage cooling path 16 during certain transient conditions, such as a sudden increase in operating speed of the engine. If the system relied solely on the temperature responsive is valve 24, components associated with the exhaust passage could possibly be damaged because of a sudden rise in temperature within the exhaust passage cooling path 16 while the temperature responsive valve 24 remains unaffected because of its distance from the exhaust passage. The inclusion of the pressure responsive valve 30 helps to alleviate this situation by reacting to an increase in pressure in the cooling system which is generally coincident with the occurrence of a transient condition such as that described above.

Figure 3:
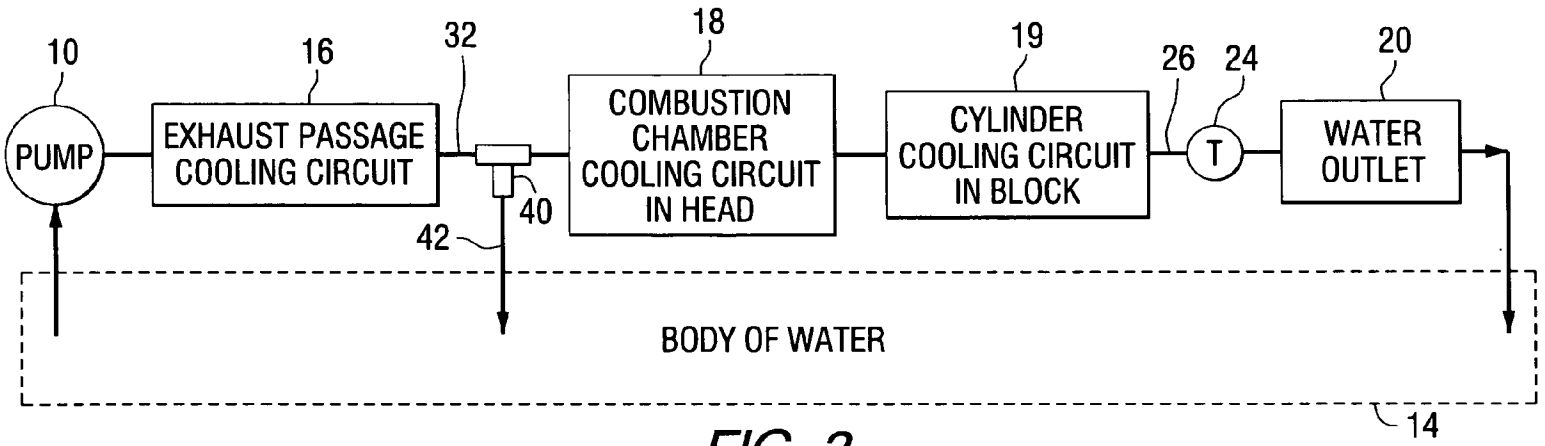
FIGS. 3-5 are simplified representations of cooling paths made in accordance with various embodiments of the present invention.

FIG. 3 is a simplified schematic representation of a cooling system for a marine engine which incorporates one of several embodiments of the present invention. A water conduit 40 is connected at the second point 32 of the cooling system which is downstream from the exhaust passage cooling path 16 and upstream from the other two cooling paths, 18 and 19. The purpose of the water conduit 40 is to provide an orifice which continuously allows a stream of water 42 to return to the body of water 14 regardless of the status of the thermally responsive valve 24. In other words, before the overall temperature of water in the cooling system exceeds a predetermined threshold at which the first thermally responsive valve 24 opens, water continues to flow through the water conduit 40. This assures a continuous passage of cooling water through the exhaust passage cooling path 16 regardless of the status of the thermally responsive valve 24. As a result, during a sudden transient condition in which the engine is accelerated from an idle speed to wide open throttle, water stream 42 will continue to flow through the orifice so that replacement water can be provided by the pump 10 in order to maintain the temperature of the exhaust passage at acceptable levels. The water conduit 40 can include a simple orifice-like opening that is connected to a conduit which directs the water stream 42 toward the body of water 14.

With continued reference to FIGS. 1-3, it should be understood that the exhaust passage cooling path 16 is intended to include any common exhaust passage and any individual exhaust conduits contained within the engine. In certain applications, the common exhaust passage and the individual exhaust conduits can be contained within the head or the block of the engine and can be formed as integral portions of the engine structure.

Figure 4:
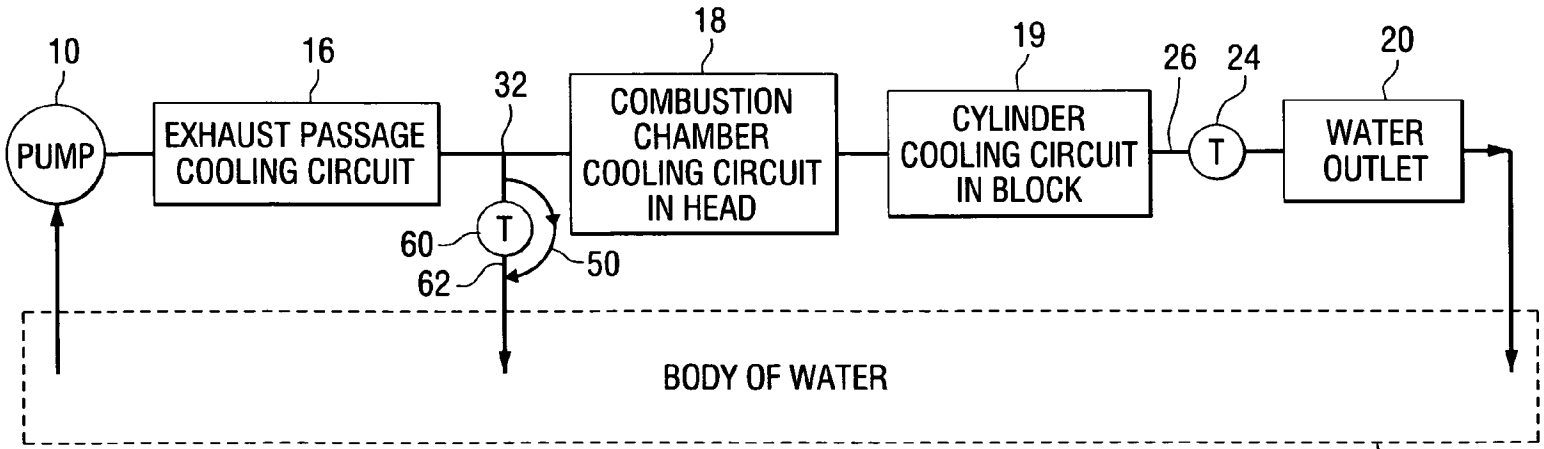

FIG. 4 illustrates an alternative embodiment of the present invention. The water conduit, which is identified by reference numeral 40 in FIG. 3, is identified by reference numeral 50 in FIG. 4. It provides a bypass conduit around a second thermally responsive valve 60 which is connected in fluid communication with the second point 32 of the cooling system. The intended operation of the system shown in FIG. 4 includes the opening of the second thermally responsive valve 60 in response to an increase in temperature at the second point 32 above a second threshold magnitude. However, the water conduit 50 is intended to act as a bypass conduit which allows a continuous flow of water around or through the second thermally responsive valve 60. In other words, even when the cooling water within the exhaust passage cooling path 16 is below the second threshold magnitude, a continuous flow of water passes through the water conduit 50 and returns to the body of water 14. Naturally, when the second thermally responsive valve 60 opens in response to an increase in temperature at the second point 32 above the second preselected temperature threshold, an increased flow of water will pass through the stream 62 shown in FIG. 4.

With continued reference to FIG. 4, it can be seen that the flow of water through the serial cooling system is controlled by both the first and second, 24 and 60, thermally responsive valves. When the temperature of the water at the first point 26 exceeds the first threshold, the first thermally responsive valve 24 opens to allow water to flow through the water outlet 20 and returned to the body of water 14. However, during transient conditions when the water within the exhaust passage cooling path 16 exceeds the second preselected temperature threshold, the second thermally responsive valve 60 opens to allow water to return to the body of water 14, regardless of the status of the first thermally responsive valve 24.

Figure 5:
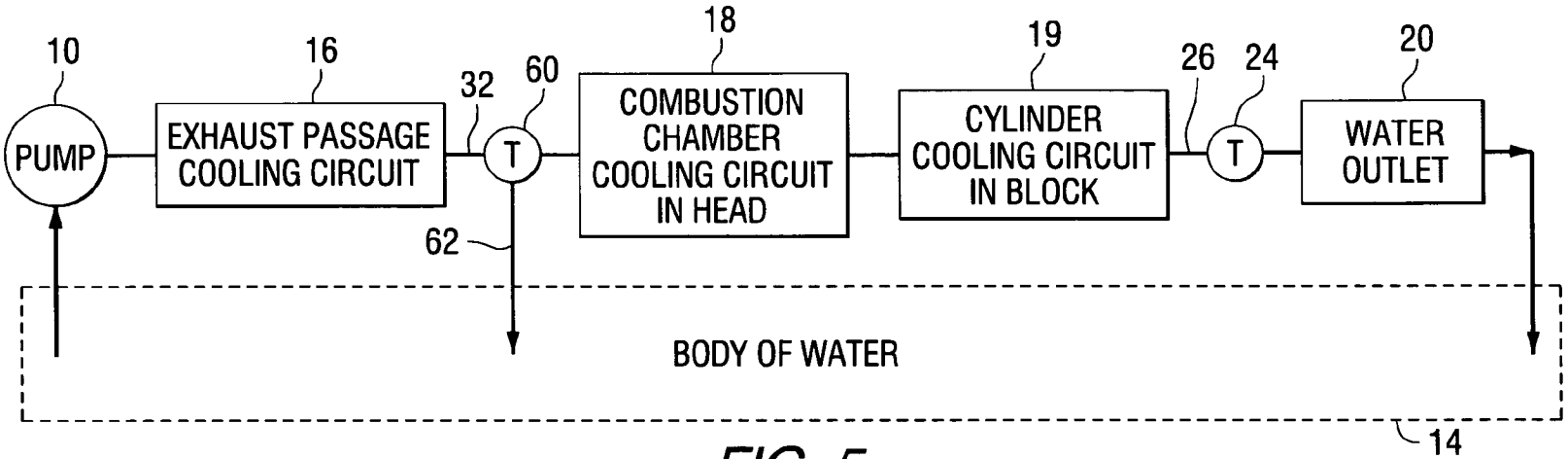

FIG. 5 is generally similar to FIG. 4, but without the bypass around the second thermally responsive valve 60 as provided by the water conduit 50 in FIG. 4. As a result, water is not induced to flow through the exhaust passage cooling path 16 until the first or second thermally responsive valves, 24 or 60, opens in response to an increased temperature at the first or second points. The continual flow of water around the second thermally responsive valve 60, identified by reference numeral 62 in FIG. 4, is not provided in the embodiment of the present invention shown in FIG. 5. If the first thermally responsive valve 24 remains closed, water does not flow through the exhaust passage cooling path 16 until the second thermally responsive valve 60 opens in response to the increase in temperature at the second point 32 above the second preselected threshold magnitude.

Figure 6:
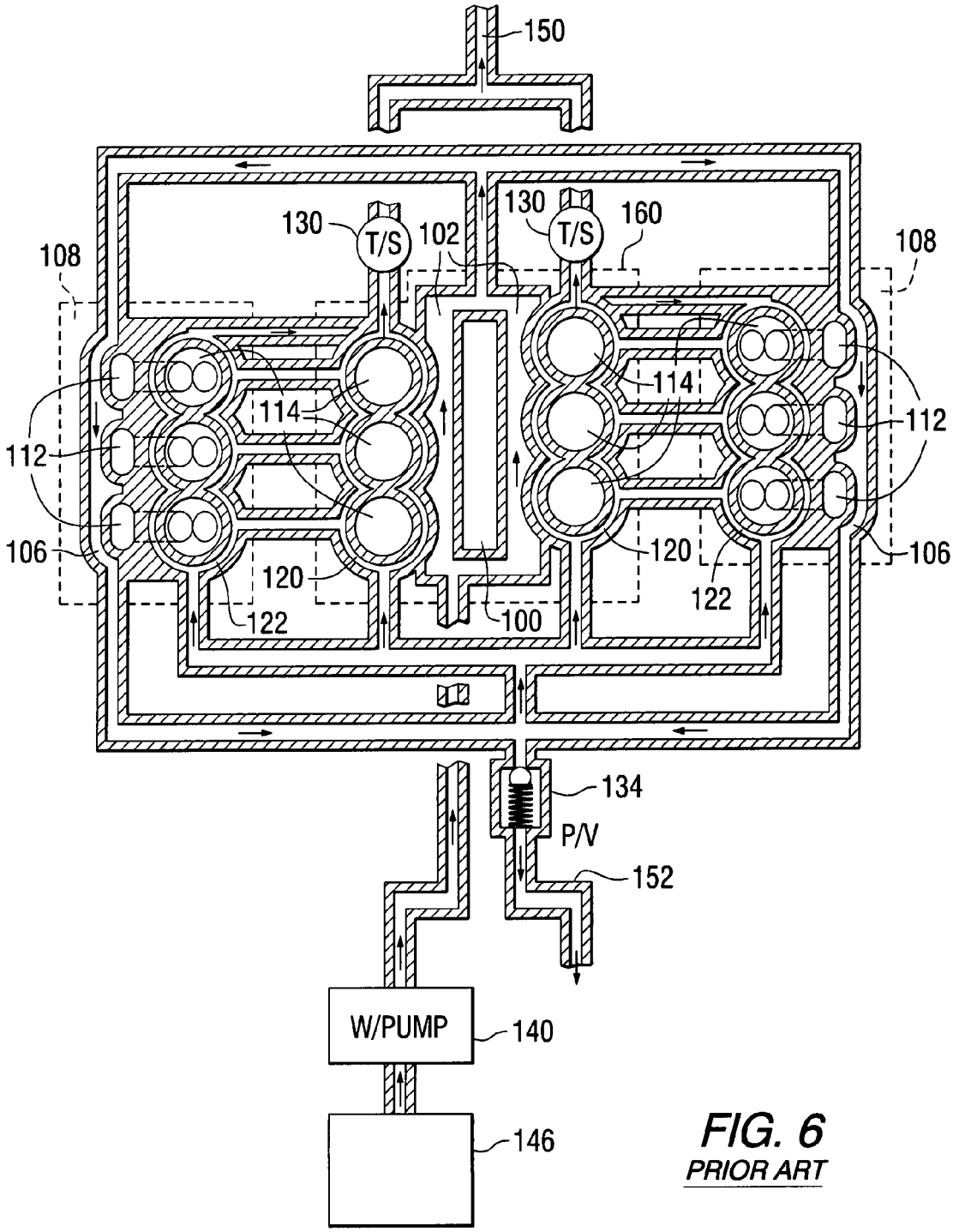
FIG. 6 PRIOR ART
FIG. 6 is an illustration of a cooling path similar to one described in detail in U.S. Pat. No. 5,769,038.

FIG. 6 illustrates a cooling system such as that which is described in detail in U.S. Pat. No. 5,769,038. A cooling system of this type is also illustrated in FIG. 19 of U.S. Pat. No. 5,769,038 and described, with different reference numerals than FIG. 6 of the present application, in that United States patent. The schematic representation shown in FIG. 6 is functionally similar to the more simplified representation illustrated in FIG. 2 and described above. A common exhaust passage 100, a coolant passage 102 connected in thermal communication with the common exhaust passage 100, and a coolant passage 106 are shown in FIG. 6. The coolant passage 106 is positioned to remove heat from the cylinder head 108. An exhaust passage 112 is also shown as being disposed in thermal communication with coolant passage 106. Combustion chambers 114 are identified and shown in association with coolant passages 120 and 122. Thermostats 130 and a pressure relief valve 134 are also shown in FIG. 6. The thermostats 130 are analogous to the thermally responsive valve 24 described above in conjunction with FIG. 2. Similarly, the pressure sensitive valve 134 in FIG. 6 is analogous to the pressure responsive valve 30 described above in conjunction with FIG. 2. The various components shown in FIG. 6 are portions of a V-type engine and are therefore illustrated symmetrically as pairs of components in FIG. 6. A water pump 140 is provided to draw water from a water source 146, such as a body of water. The conduit identified by reference numeral 150 in FIG. 6 provides a water return path through which water is emitted back to a body of water. The conduit identified by reference numeral 152 in FIG. 6 permits the water passed through the pressure sensitive valve 134 to return to the body of water. The cylinder block is identified by reference numeral 160.

With reference to FIGS. 2 and 6, the illustrated cooling systems provide pressure responsive valves, such as those identified by reference numerals 30 and 134, to induce a flow of cooling water through the cooling passages 102, and 106, associated with the exhaust passages of the engine. This allows additional cooling water to be conducted through those exhaust-related passages in the event of a transient condition when the operating speed of the engine is suddenly increased. This allows the cooling system to respond to this type of transient condition even though the temperature near the thermostats 130 has not yet exceeded the first threshold at which they are configured to open.

Figure 7:
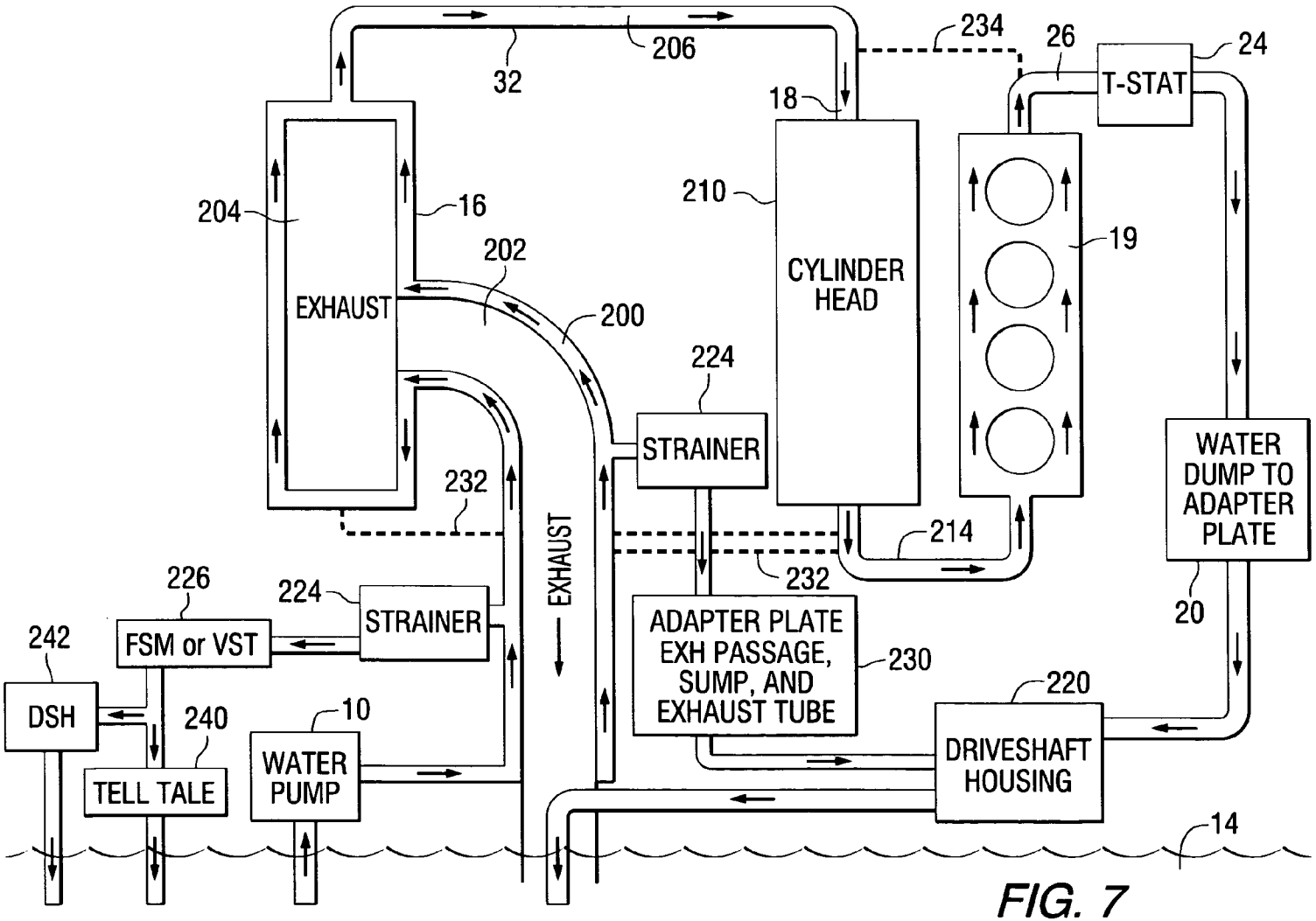
FIG. 7 shows a cooling system with a single thermally responsive valve and no pressure responsive valve.

FIG. 7 illustrates a cooling system that draws water through a water pump 10 and conducts the water through a cooling conduit 200 associated with an exhaust pipe 202 which leads to an exhaust passage cooling path 16 associated with an exhaust conduit 204 which can be formed as an integral portion of the head of the engine. The cooling water then flows through a conduit 206 at which the second point 32, described above in conjunction with FIGS. 3-5, is located. Although not shown in FIG. 7, the second point 32 at conduit 206 can be used advantageously to provide necessary cooling of the exhaust conduit 204 during transient conditions. These relationships will be described below. The cylinder head is identified by reference numeral 210 in FIG. 7 and is cooled by a combustion chamber cooling path 18. Water flowing through the combustion chamber cooling path 18 then continues to flow, through conduit 214, into the cylinder cooling path 19. From there the water flows past the first point 26 to the thermally responsive valve 24, such as a thermostat. When the thermostat opens in response to an increase in temperature at the first point 26 to a magnitude greater than a first threshold temperature, the water is conducted through a water outlet 20 and down into and through a driveshaft housing 220 of the outboard motor.

Although not directly related to the present invention, additional components are also illustrated in FIG. 7. Strainers 224, a fuel system module 226, and adapter plate 230, drain conduits 232, and an air bleed conduit 234, are also shown in FIG. 7. In addition, a telltale conduit 240 and a driveshaft housing water bearing 242 are shown.

Figure 8:
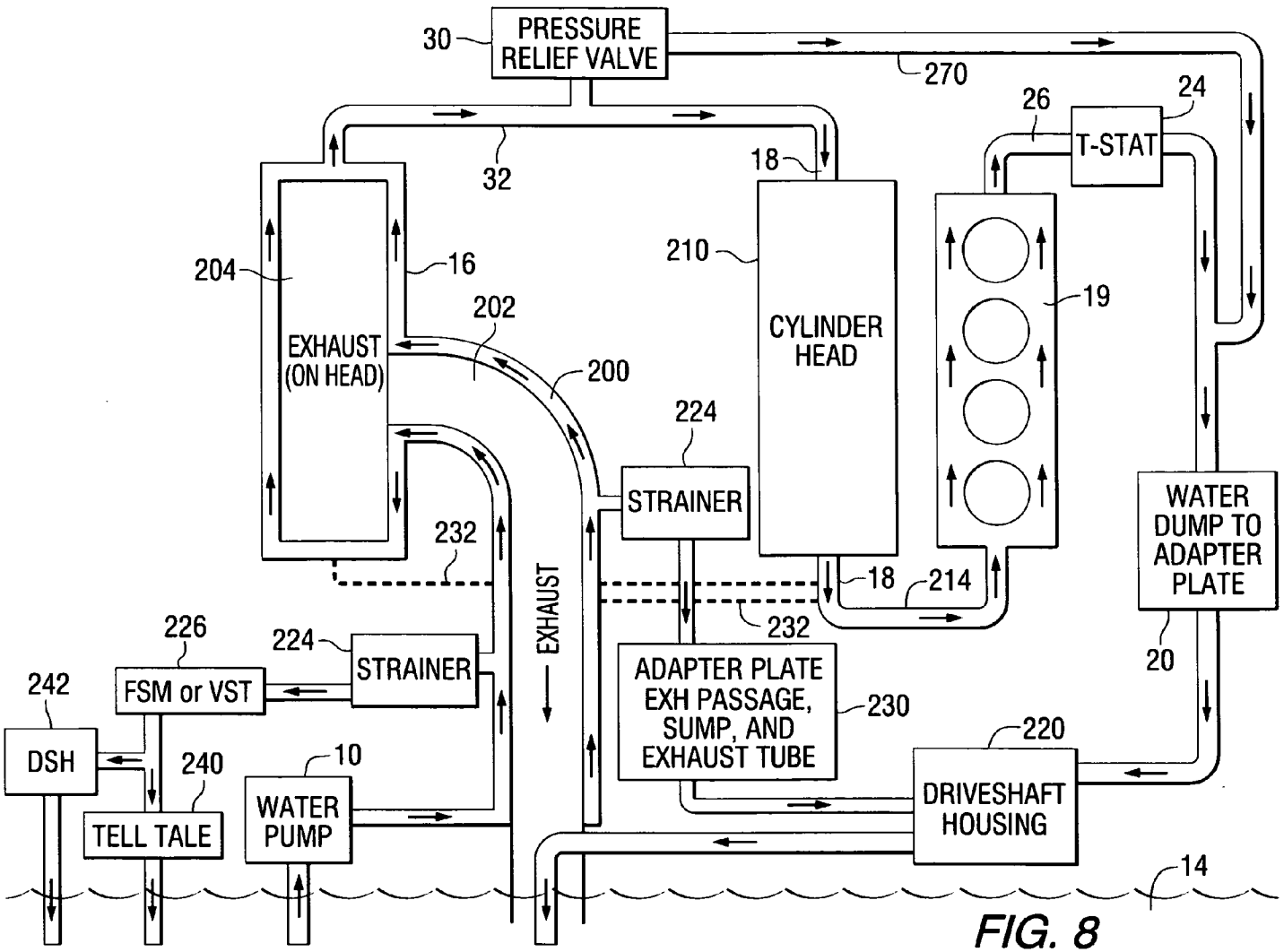
FIG. 8 shows a cooling system with a thermally responsive valve and a pressure relief valve.

FIG. 8 is generally similar to FIG. 7, but with a pressure relief valve 30 connected in fluid communication with the conduit at which the second point 32 is located. During transient conditions, when the pressure at the second point 32 exceeds a preselected threshold, the pressure relief valve 30 opens and allows water to flow through conduit 270 to a location downstream from the thermally responsive valve 24, or thermostat. This induces a flow of water through the exhaust passage cooling path 16 even though the thermally responsive valve 24 is closed. This prevents damage to the components associated with the exhaust passage 204 in the event that a sudden increase in engine operating speed raises the temperature within the exhaust passage 204 prior to an associated increase in temperature at the first point 26. The system shown in FIG. 8 operates generally similarly to the system described above in conjunction with FIG. 2.

Figure 9:
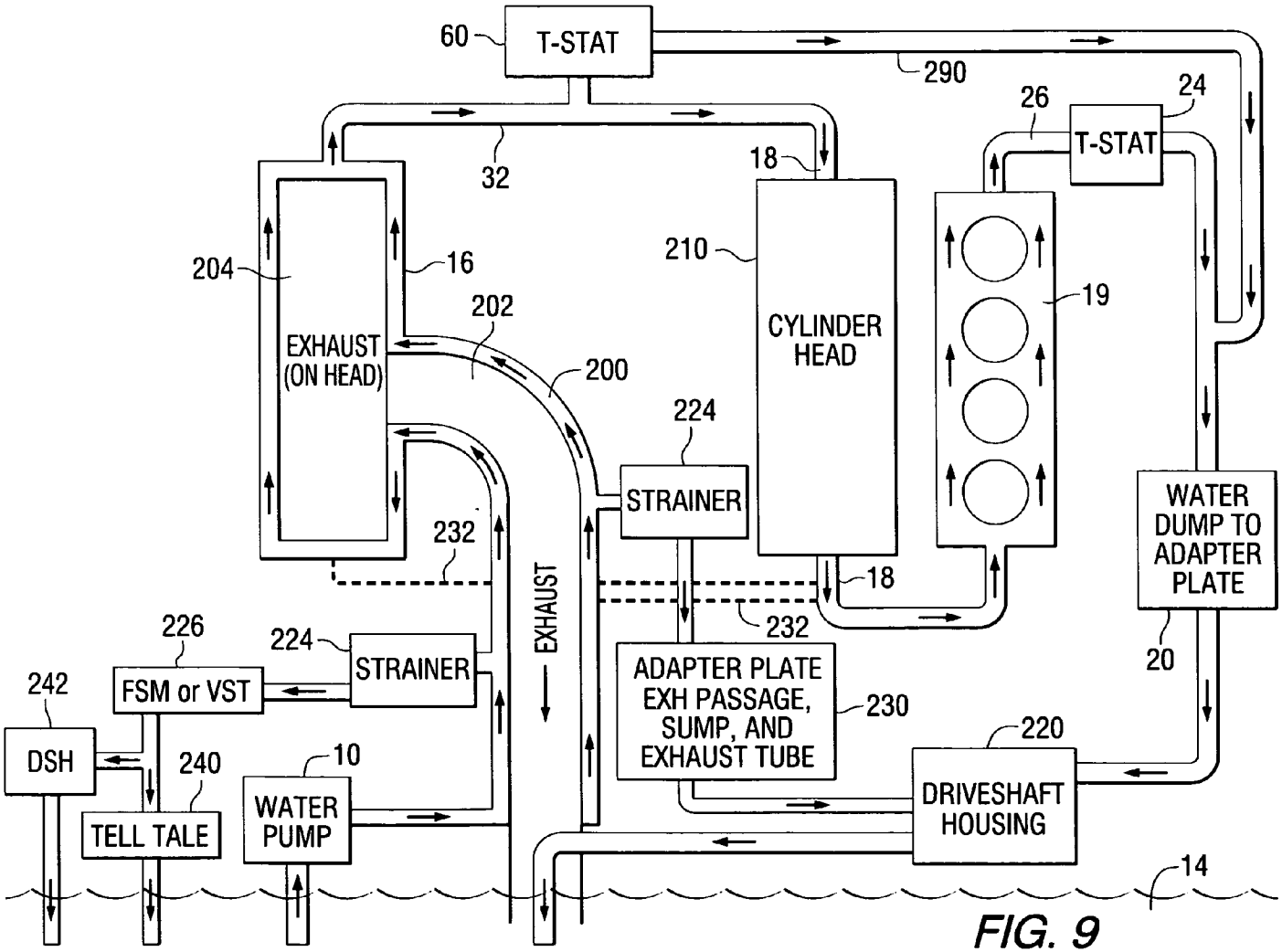
FIG. 9 illustrates an embodiment of the present invention in which two thermally responsive valves are connected in series fluid communication with each other.

FIG. 9 shows a cooling system that is generally similar to the cooling system described above in conjunction with FIG. 5. It uses a second thermally responsive valve 60 connected in fluid communication with the second point 32. This directs a flow of diverted water through conduit 290 when the temperature at the second point 32 exceeds a second threshold magnitude. This water is conducted through conduit 290 to a location downstream from the thermally responsive valve 24 which is downstream from the combustion chamber cooling path 18 in the head 210 and the cylinder cooling path 19 in the block of the engine. This water then flows through the water outlet 20 and is returned to the body of water 14. The other components shown in FIG. 9 are generally similar to those described above in conjunction with FIGS. 7 and 8.

Figure 10:
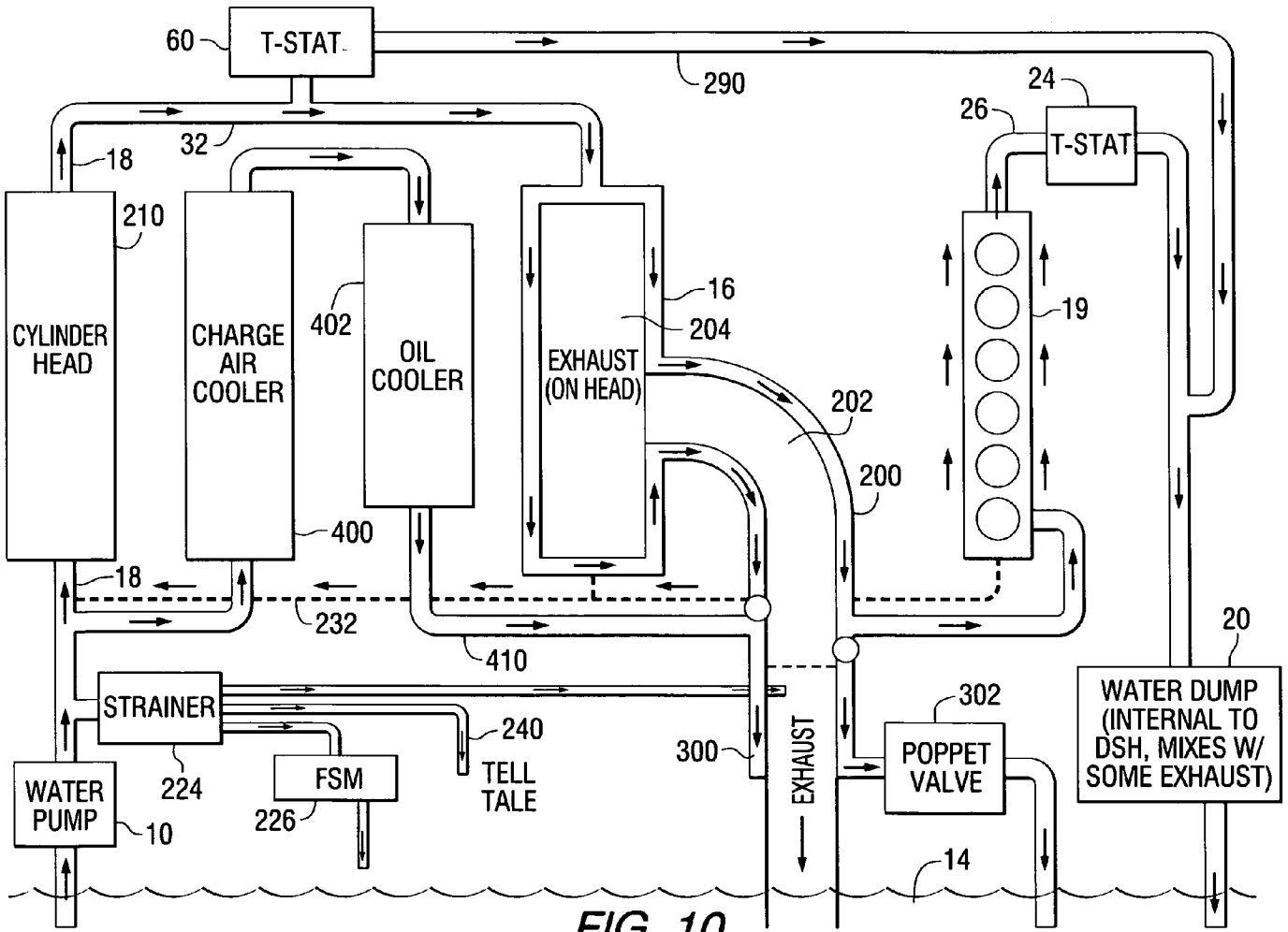
FIG. 10 is an alternative embodiment of the present invention in which two thermally responsive valves are connected in series fluid communication with each other.

FIG. 10 shows an alternative embodiment of the present invention. In FIG. 10, the combustion chamber cooling path 18 in the cylinder head 210 is located upstream from the other components of the cooling system. The water pump 10 directs a flow of cooling water, drawn from a body of water 14, through the combustion chamber cooling path 18 in the head. This cooling water then flows in serial fluid communication to the exhaust passage cooling path 16 and then through the exhaust pipe cooling path 200 which removes heat from the exhaust pipe 202 which directs a flow of exhaust gas through the block of the engine and then downwardly through the driveshaft housing where it is cooled by a cooling path 300. A pressure sensitive poppet valve 302 is used in conjunction with the cooling path 300. After flowing through the combustion chamber cooling path 18 and the exhaust passage cooling path 16, the water flows through the cylinder cooling path 19 in the cylinder block of the engine. A second thermally responsive valve 60 diverts water through conduit 290 to a location downstream from the first thermally responsive valve 24 when the temperature at the second point 32 exceeds a second predetermined threshold.

Some cooling water provided by the water pump 10 is directed to provide cooling for a charge air cooler 400 and an oil cooler 402. This water is then conducted, through conduit 410, to the cooling path comprising paths 200 and 300.

Although the cooling system shown in FIG. 10 appears significantly different than the cooling path shown in FIG. 9, it should be understood that the basic concept of the present invention is incorporated in both systems. More specifically, the first and second thermally responsive valves, 24 and 60, are connected in series fluid communication with each other. In FIGS. 9 and 10, which show two embodiments of the present invention, the first thermally responsive valve 24 is connected downstream from several cooling paths. The second thermally responsive valve 60 is connected downstream from one of the cooling paths, but upstream from the other cooling paths. The second thermally responsive valve 60 responds to a temperature at a second point 32 which is downstream from the first cooling path in the serial arrangement. The first thermally responsive valve 24 is located at a first point 26 which is downstream from the other cooling paths.

Comparing FIGS. 9 and 10, the first cooling path in FIG. 9 is the exhaust passage cooling path 16. In FIG. 10, the first cooling path is the combustion chamber cooling path 18 in the cylinder head 210. Continuing this comparison of FIGS. 9 and 10, in FIG. 9 the downstream cooling paths include the combustion chamber cooling path 18 and the cylinder cooling path 19 in FIG. 9. These downstream cooling paths in FIG. 10 include the exhaust passage cooling path 16 and the cylinder cooling path 19. Even though the specific arrangements of the first, second, and third cooling paths differ in FIGS. 9 and 10, the basic concept of the present invention remains the same. In other words, two thermally responsive valves, 24 and 26, are arranged in a serial relationship with each other. In addition, the respective functions of the first and second thermally responsive valves, 24 and 60, are the same in FIGS. 9 and 10. More specifically, the second thermally responsive valve 60 at the second point 32 reacts to the temperature within the first cooling path, regardless if it is the exhaust passage cooling path 16 in FIG. 9 or the combustion chamber cooling path 18 in the cylinder head 210 in FIG. 10. The first thermally responsive valve 24, on the other hand, reacts to the temperature associated with the downstream cooling paths.

Although the present invention has been described in particular specificity and illustrated to show several preferred embodiments, it should be understood that alternative embodiments are also within its scope.

We claim:

1. A cooling system for a marine propulsion engine, comprising:

first and second cooling paths connected in series fluid communication with each other;

a water pumping device connected in series fluid communication with said first and second cooling paths and configured to pump water from a body of water and cause said water to flow through said first and second cooling paths, said second cooling path being disposed downstream from said first cooling path;

a first thermally responsive valve connected in fluid communication with a first point of said cooling system which is downstream from said second cooling path, said first thermally responsive valve being configured to allow water to flow out of said second cooling path in response to a temperature of said water at said first point exceeding a first temperature threshold;

a water conduit connected in fluid communication with a second point of said cooling system which is downstream of said first cooling path and upstream of said second cooling path, said water conduit being configured to direct water to flow out of said first cooling path; and a second thermally responsive valve connected in thermal communication with said second point of said cooling system, said water conduit being a bypass conduit connected in fluid communication with said second thermally responsive valve.

2. The cooling system of claim 1, wherein:

said first cooling path is an exhaust passage cooling path which is disposed in thermal communication with an exhaust passage which is formed as an integral part of said engine.

3. The cooling system of claim 2, wherein:

said second cooling path is a combustion chamber cooling path which is disposed in thermal communication with at least one combustion chamber formed in a head portion of said engine.

4. The cooling system of claim 2, wherein:

said second cooling path is a cylinder cooling path which is disposed in thermal communication with at least one cylinder formed in a block portion of said engine.

5. The cooling system of claim 1, further comprising:

a water outlet connected in fluid communication with said first and second cooling paths and configured to return water to said body of water after said water has passed through said first and second cooling paths.

6. The cooling system of claim 1, further comprising:

a third cooling path connected in series fluid communication with said first and second cooling paths.

7. A cooling system for a marine propulsion engine, comprising:

a first cooling path disposed in thermal communication with a first heat emitting portion of said engine;

a second cooling path disposed in thermal communication with a second heat emitting portion of said engine a water pump configured to draw water from a body of water and cause said water to flow sequentially through said first cooling path and then through said second cooling path;

a water outlet connected in series fluid communication downstream from said second cooling path for conducting said water back to said body of water;

a first thermally responsive valve disposed in thermal communication with a first point of said cooling system which is downstream from said second cooling path and upstream from said water outlet;

a water diversion conduit disposed in fluid communication with a second point of said cooling system which is downstream from said first cooling path and upstream from said second cooling path, said water diversion conduit being configured to return said water to said body of water after said water has flowed through said first cooling path; and a second thermally responsive valve disposed in thermal communication with said second point of said cooling system, said water diversion conduit being a bypass conduit connected in fluid communication with said second thermally responsive valve.

8. The cooling system of claim 7, wherein:

said first heat emitting portion of said engine is an exhaust passage through which exhaust gases are directed away from said engine.

9. The cooling system of claim 8, wherein:

said exhaust passage is formed as an integral part of said engine.

10. The cooling system of claim 8, wherein:

said second heat emitting portion of said engine comprises at least one combustion chamber of said engine.

11. The cooling system of claim 7, further comprising:

a third cooling path disposed in thermal communication with a third heat emitting portion of said engine, said third cooling path being connected in series fluid communication with and downstream from said second cooling path.

12. The cooling system of claim 11, wherein:

said third heat emitting portion of said engine comprises at least one cylinder of said engine.

13. A cooling system for a marine propulsion engine, comprising:

a first cooling path disposed in thermal communication with a first heat emitting portion of said engine;

a second cooling path disposed in thermal communication with a second heat emitting portion of said engine a water pump configured to draw water from a body of water and cause said water to flow in series initially through said first cooling path and then through said second cooling path;

a water outlet connected in series fluid communication downstream from said second cooling path for conducting said water back to said body of water;

a first thermally responsive valve disposed in thermal communication with a first point of said cooling system which is downstream from said second cooling path and upstream from said water outlet;

a second thermally responsive valve disposed in thermal communication with a second point of said cooling system which is downstream from said first cooling path and upstream from said second cooling path, said second thermally responsive valve being configured to divert said water back to said body of water in response to said water at said second point having a temperature greater than a preselected threshold magnitude.

14. The cooling system of claim 13, further comprising:

a water diversion conduit disposed in fluid communication with said second point of said cooling system.

15. The cooling system of claim 14, wherein:

said water diversion conduit is a bypass conduit connected in fluid communication with said second thermally responsive valve.

16. The cooling system of claim 13, wherein:

said first heat emitting portion of said engine is an exhaust passage through which exhaust gases are directed away from said engine.

17. The cooling system of claim 16, wherein:

said exhaust passage is formed as an integral part of said engine.

18. The cooling system of claim 13, wherein:

said second heat emitting portion of said engine comprises at least one combustion chamber of said engine.

19. The cooling system of claim 13, further comprising:

a third cooling path disposed in thermal communication with a third heat emitting portion of said engine, said third cooling path being connected in series fluid communication with and downstream from said second cooling path.

20. The cooling system of claim 19, wherein:

said third heat emitting portion of said engine comprises at least one cylinder of said engine.

21. A cooling system for a marine propulsion engine, comprising:

an exhaust passage cooling path disposed in thermal communication with a common exhaust passage of said engine;

a combustion chamber cooling path disposed in thermal communication with combustion chambers of said engine and connected in series fluid communication with said exhaust passage cooling path;

a cylinder cooling path disposed in thermal communication with cylinders of said engine and connected in series fluid communication with said combustion chamber cooling path, said exhaust passage cooling path being connected in series fluid communication with said cylinder cooling path;

a water pump connected in series fluid communication with said exhaust passage cooling path, said combustion chamber cooling path, and said cylinder cooling path and upstream of said exhaust passage cooling path;

a first thermally responsive valve connected in fluid communication with a first point which is downstream from and in series fluid communication with said cylinder cooling path, said first thermally responsive valve being configured to permit water within said cylinder cooling path to flow through said cylinder cooling path in response to a temperature of said water within said cylinder cooling path exceeding a first temperature threshold;

a water conduit connected in fluid communication between a second point, which is downstream from and in series fluid communication with said exhaust passage cooling path, and a third point which is downstream from said cylinder cooling path; and a second thermally responsive valve connected in fluid communication with a second point which is downstream from and in series fluid communication with said exhaust passage cooling path, said second thermally responsive valve being configured to permit water within said exhaust passage cooling path to flow through said exhaust passage cooling path in response to a temperature of said water within said exhaust passage cooling path exceeding a second temperature threshold.

22. The cooling system of claim 21, wherein:

said water conduit is a bypass conduit connected in fluid communication with said second thermally responsive valve to permit a continuous flow of said water past said second thermally responsive valve from said exhaust passage cooling path to said third point.

23. A cooling system for a marine propulsion engine, comprising:

an exhaust passage cooling path disposed in thermal communication with a common exhaust passage of said engine;

a combustion chamber cooling path disposed in thermal communication with combustion chambers of said engine and connected in series fluid communication with said exhaust passage cooling path;

a cylinder cooling path disposed in thermal communication with cylinders of said engine and connected in series fluid communication with said combustion chamber cooling path, said exhaust passage cooling path being connected in series fluid communication with said cylinder cooling path;

a water pump connected in series fluid communication with said exhaust passage cooling path, said combustion chamber cooling path, and said cylinder cooling path and upstream of said exhaust passage cooling path;

a first thermally responsive valve connected in fluid communication with a first point which is downstream from and in series fluid communication with said cylinder cooling path, said first thermally responsive valve being configured to permit water within said cylinder cooling path to flow through said cylinder cooling path in response to a temperature of said water within said cylinder cooling path exceeding a first temperature threshold; and a second thermally responsive valve connected in fluid communication with a second point which is downstream from and in series fluid communication with said exhaust passage cooling path, said second thermally responsive valve being configured to permit water within said exhaust passage cooling path to flow through said exhaust passage cooling path in response to a temperature of said water within said exhaust passage cooling path exceeding a second temperature threshold.

24. The cooling system of claim 23, further comprising:

a water conduit connected in fluid communication between said second point, which is downstream from and in series fluid communication with said exhaust passage cooling path, and a third point which is downstream from said cylinder cooling path.

25. The cooling system of claim 24, wherein:

said water conduit is a bypass conduit connected in fluid communication with said second thermally responsive valve to permit a continuous flow of said water past said second thermally responsive valve from said exhaust passage cooling path to said third point.

* * * * *